US008662642B2

(12) United States Patent
Komamiya et al.

(10) Patent No.: US 8,662,642 B2
(45) Date of Patent: Mar. 4, 2014

(54) LIQUID EJECTION HEAD

(75) Inventors: Yumi Komamiya, Kawasaki (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/552,725

(22) Filed: Jul. 19, 2012

(65) Prior Publication Data

US 2013/0033547 A1 Feb. 7, 2013

(30) Foreign Application Priority Data

Aug. 5, 2011 (JP) ..... 2011-172092

(51) Int. Cl.
*B41J 2/02* (2006.01)

(52) U.S. Cl.
USPC ..... 347/65

(58) Field of Classification Search
None
See application file for complete search history.

(56) References Cited

U.S. PATENT DOCUMENTS

| | | | | |
|---|---|---|---|---|
| 6,065,823 | A * | 5/2000 | Kawamura | 347/18 |
| 6,481,819 | B2 * | 11/2002 | Kaneko et al. | 347/15 |
| 6,543,884 | B1 | 4/2003 | Kawamura et al. | |
| 7,591,531 | B2 | 9/2009 | Tsuchii et al. | |
| 8,201,925 | B2 | 6/2012 | Saito et al. | |
| 2010/0201748 | A1 | 8/2010 | Kishikawa et al. | |
| 2010/0201754 | A1 * | 8/2010 | Tsuchii et al. | 347/65 |

FOREIGN PATENT DOCUMENTS

JP 2001-71502 A 3/2001

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head includes a substrate having an energy-generating element for generating energy to be used for ejecting a liquid and a supply port in the form of a through-hole for supplying the liquid to the energy-generating element, and an orifice plate including an ejection orifice for ejecting the liquid. A plurality of the energy-generating elements is arranged in a first direction. The supply port is formed between the plurality of the energy-generating elements in the first direction, and the supply port is formed so as to be adjacent to the energy-generating element in a second direction orthogonal to the first direction.

8 Claims, 13 Drawing Sheets

LIQUID EJECTION HEAD

BACKGROUND OF THE INVENTION

1. Field of the Invention

The present invention relates to a liquid ejection head for ejecting liquid such as ink filled in a pressure chamber from an ejection orifice through use of an energy-generating element such as an electrothermal conversion element or a piezoelectric element.

2. Description of the Related Art

In a general liquid ejection recording apparatus, ink is supplied to a liquid ejection head from an ink tank. The liquid ejection head ejects ink toward a recording medium. In the liquid ejection head, ink is filled in a pressure chamber through a supply port. The ink filled in the pressure chamber is ejected from an ejection orifice by an energy-generating element typified by an electrothermal conversion element or a piezoelectric element. After that, the ink is refilled in the pressure chamber through the supply port, that is, so-called refilling is performed.

In the above-mentioned liquid ejection head, as a technique for preventing a foreign matter from entering the pressure chamber, there is known a technique of forming two ink supply ports with respect to one ejection orifice, the two ink supply ports being smaller than the one ejection orifice (see Japanese Patent Application Laid-Open No. 2001-71502).

As for the phenomenon of having an adverse effect on ink ejection in the liquid ejection head, there is a phenomenon, a so-called cross talk, in which a pressure wave generated by the energy-generating element propagates to another pressure chamber, in addition to the phenomenon in which a foreign matter enters a pressure chamber. When an ink flow path is narrowed, the ink flow is suppressed by a viscosity resistance from a wall surface, and hence, the cross talk is alleviated. However, when the ink flow resistance increases, the refilling speed decreases, and hence, the ejection frequency of ink cannot be increased. More specifically, when an attempt is made so as to alleviate the cross talk, the throughput cannot be enhanced.

SUMMARY OF THE INVENTION

A liquid ejection head includes: a substrate including an energy-generating element for generating energy to be used for ejecting a liquid, and a supply port that is a through-hole for supplying the liquid to the energy-generating element; and an orifice plate including an ejection orifice for ejecting the liquid, in which a plurality of the energy-generating elements are arranged in a first direction, and in which the supply port is formed between the plurality of the energy-generating elements in the first direction, and the supply port is formed so as to be adjacent to the energy-generating element in a second direction orthogonal to the first direction.

Further features of the present invention will become apparent from the following description of exemplary embodiments with reference to the attached drawings.

DESCRIPTION OF THE EMBODIMENTS

Figure 13:
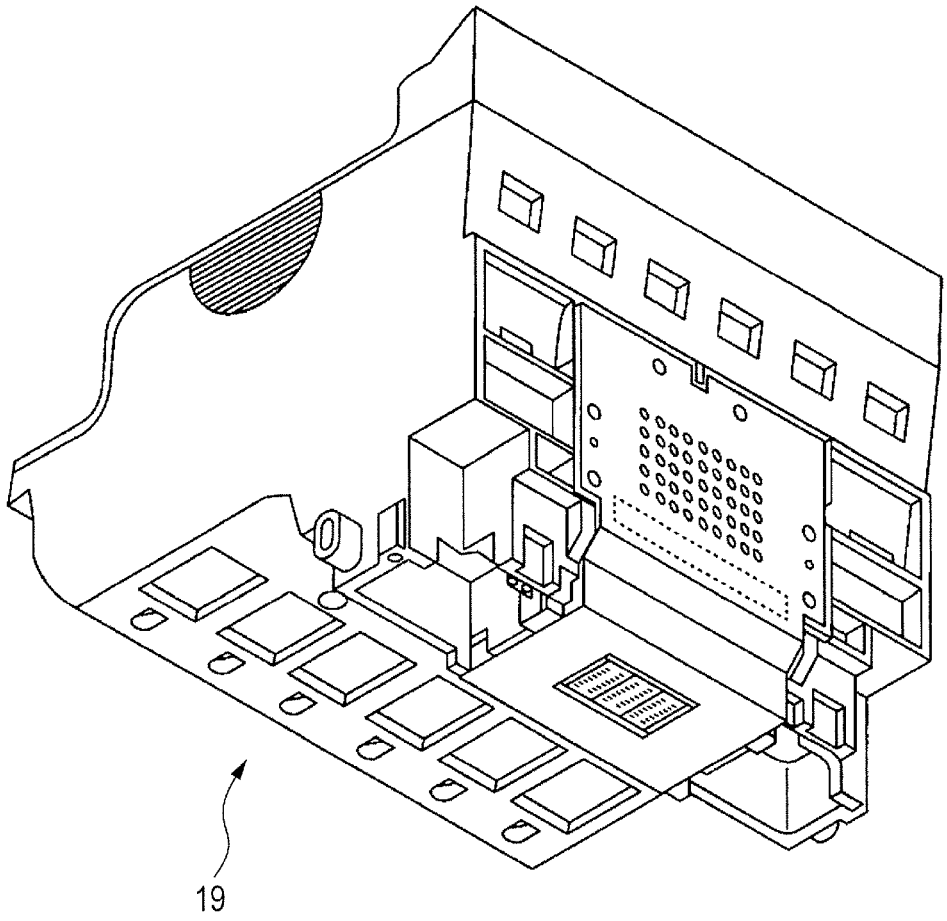
FIG. 13 is a perspective view of the liquid ejection head to be mounted on the liquid ejection recording apparatus illustrated in FIG. 12, viewed from below.
Figure 14:
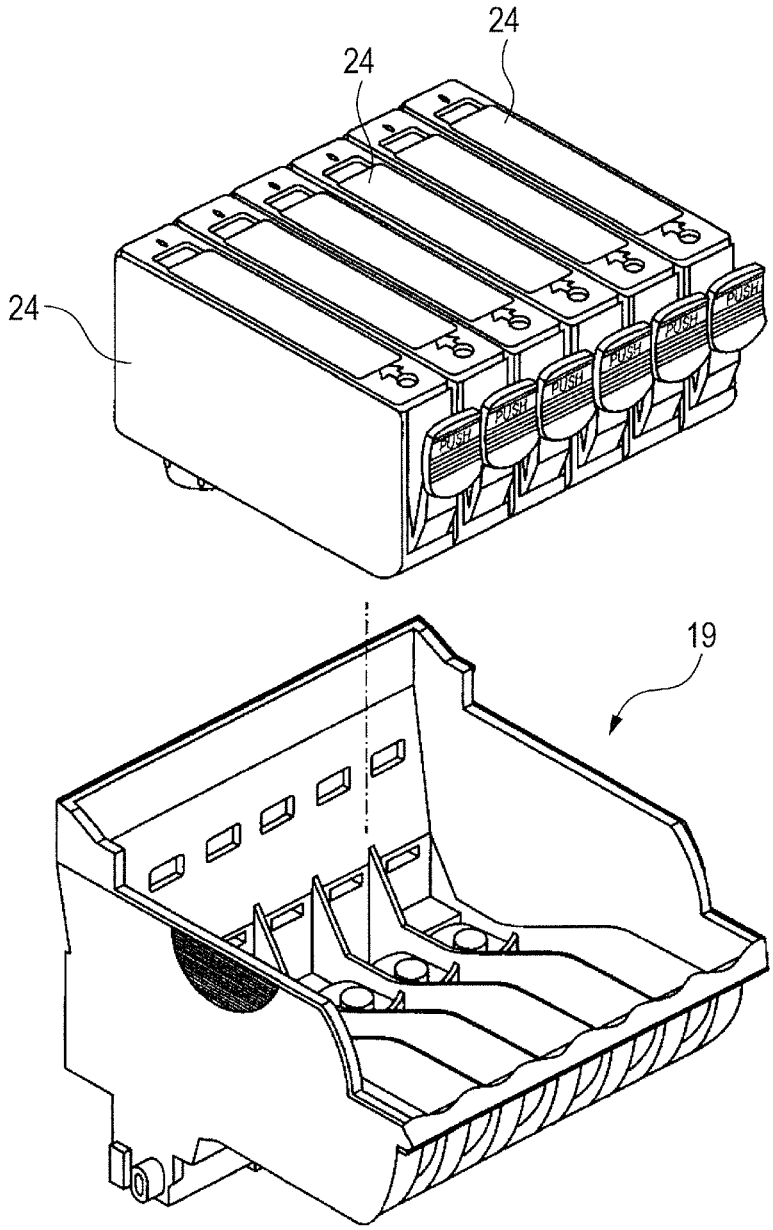
FIG. 14 is an exploded perspective view of the liquid ejection head illustrated in FIG. 13, viewed from above.

Hereinafter, prior to the description of embodiments of the present invention, a configuration of a liquid ejection recording apparatus, to which a liquid ejection head of the present invention is applicable, is described with reference to FIGS. 12 to 14.

Configuration of a Liquid Ejection Recording Apparatus

Figure 12:
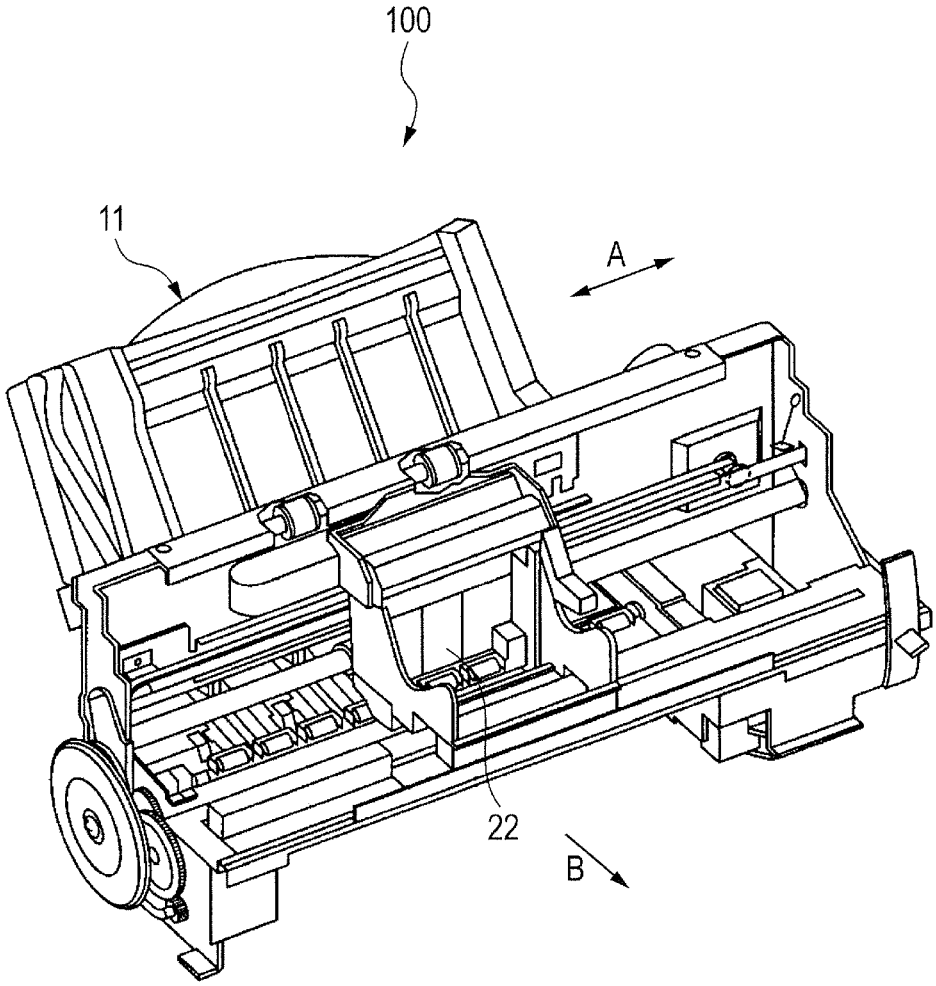
FIG. 12 is a perspective view illustrating a main internal configuration of a liquid ejection recording apparatus on which a liquid ejection head of the present invention is mounted.

FIG. 12 is a perspective view illustrating a main internal configuration of a liquid ejection recording apparatus 100 on which a liquid ejection head of the present invention is mounted. FIG. 13 is a perspective view of a liquid ejection head 19 to be mounted on the liquid ejection recording apparatus 100 illustrated in FIG. 12, viewed from below. FIG. 14 is an exploded perspective view of the liquid ejection head 19 illustrated in FIG. 13, viewed from above.

In the liquid ejection recording apparatus 100 illustrated in FIG. 12, a recording medium is set on a tray 11, and the liquid ejection head 19 is mounted on a carriage 22. The recording medium is conveyed through the liquid ejection recording apparatus 100 in a conveyance direction B (see FIG. 12). The carriage 22 reciprocates in a main scanning direction A orthogonal to the conveyance direction B. Thus, the liquid ejection head 19 also reciprocates in the main scanning direction A. As illustrated in FIG. 14, multiple ink tanks 24 are removably mounted to the liquid ejection head 19.

First Embodiment

Figure 1:
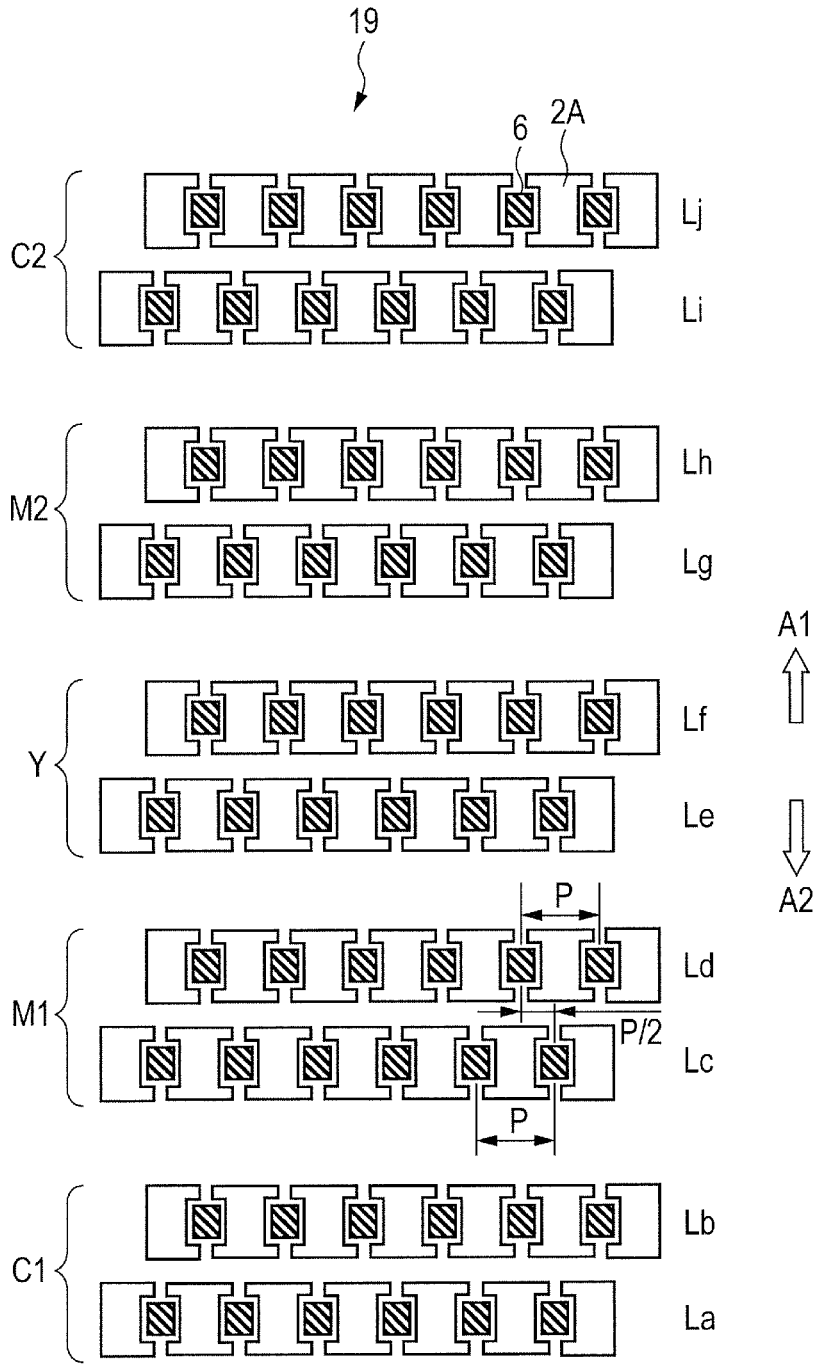
FIG. 1 is a plan view illustrating main parts of a liquid ejection head of a first embodiment of the present invention.

FIG. 1 is a plan view illustrating main parts of a liquid ejection head of a first embodiment of the present invention. As illustrated in FIG. 1, nozzle array groups C1, M1, Y, M2, and C2 are formed on the liquid ejection head 19 of this embodiment. The nozzle array groups C1 and C2 are used for ejecting cyan ink. The nozzle array group C1 includes two nozzle arrays La and Lb. The nozzle array group C2 includes two nozzle arrays Li and Lj. The nozzle array groups M1 and M2 are used for ejecting magenta ink. The nozzle array group M1 includes two nozzle arrays Lc and Ld. The nozzle array group M2 includes two nozzle arrays Lg and Lh. The nozzle array group Y is used for ejecting yellow ink and includes two nozzle arrays Le and Lf.

Figure 2:
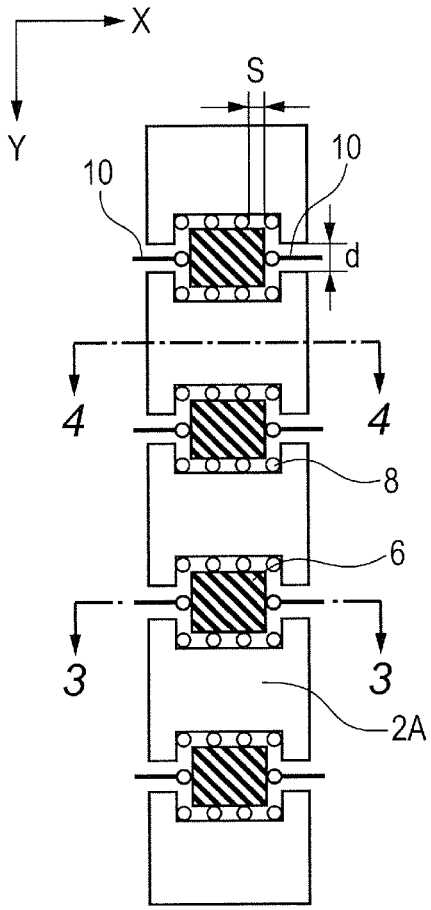
FIG. 2 is a plan view illustrating one of nozzle arrays illustrated in FIG. 1 in an enlarged state.
Figure 3:
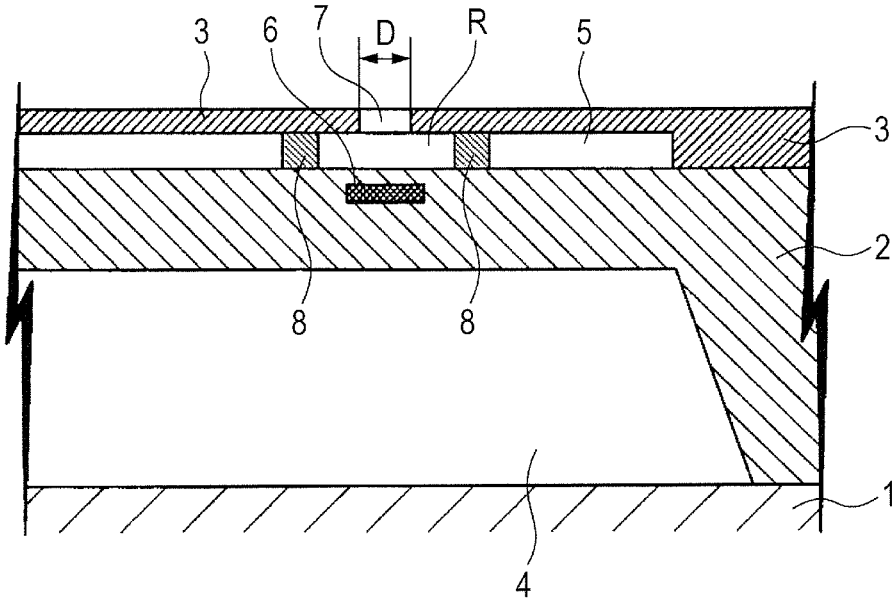
FIG. 3 is a cross-sectional view taken along a line 3-3 illustrated in FIG. 2.
Figure 4:
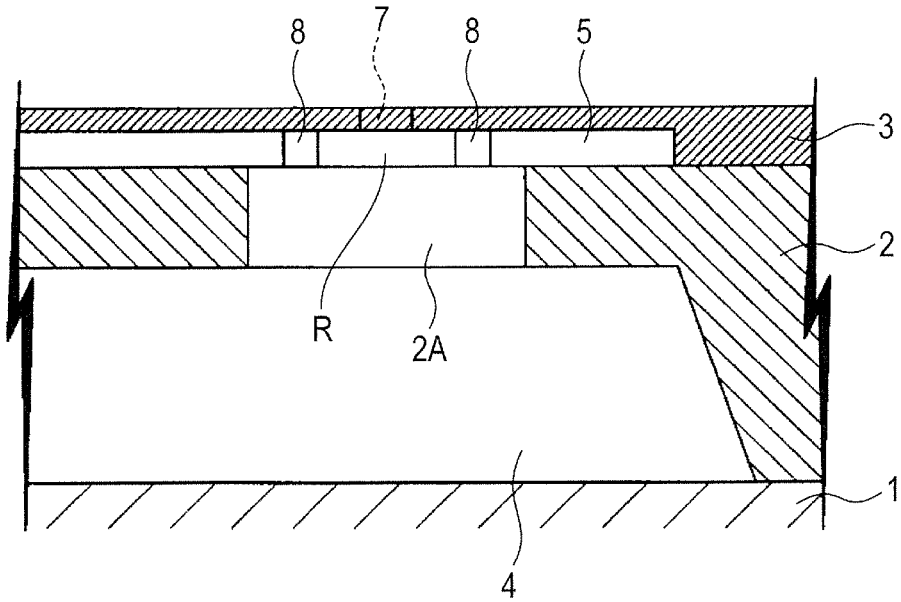
FIG. 4 is a cross-sectional view taken along a line 4-4 illustrated in FIG. 2.

FIG. 2 is an enlarged plan view of the nozzle array Ld, which is one of the above-mentioned nozzle arrays. FIG. 3 is a cross-sectional view taken along a line 3-3 illustrated in FIG. 2. FIG. 4 is a cross-sectional view taken along a line 4-4 illustrated in FIG. 2. As illustrated in FIGS. 3 and 4, the liquid ejection head 19 of this embodiment includes a support member 1, a substrate 2, and an orifice plate 3. The support member 1, the substrate 2, and the orifice plate 3 can be shared by all the nozzle arrays in the liquid ejection head 19. FIGS. 1 and 2 are plan views without the orifice plate 3.

Multiple common liquid chambers 4 corresponding to the respective array groups are formed between the support member 1 and the substrate 2. Each common liquid chamber 4 is supplied with ink from an ink tank 24. The ink supplied to the common liquid chambers 4 is filled in a liquid chamber 5 through multiple supply ports 2A passing through the substrate 2. The liquid chamber 5 is formed between the substrate 2 and the orifice plate 3. In this embodiment, the multiple supply ports 2A are arranged in a nozzle array direction Y (see FIG. 2). The substrate 2 has multiple energy-generating elements 6 formed therein for generating energy to be used for ejecting liquid, which are arranged in the nozzle array direction Y. In this embodiment, the energy-generating elements 6 are electrothermal conversion elements (heaters) for generating heat when being supplied with power through a wiring 10 (see FIG. 2). Multiple ejection orifices 7 are formed in the orifice plate 3 at positions facing the respective energy-generating elements 6.

In the nozzle array group M1, the multiple energy-generating elements 6 and ejection orifices 7 are arranged in the nozzle arrays Lc and Ld at a predetermined pitch P (see FIG. 1). Further, the energy-generating elements 6 and the ejection orifices 7 in the nozzle array Lc are shifted from the energy-generating elements 6 and the ejection orifices 7 in the nozzle array Ld by a half pitch (P/2) (see FIG. 1). Thus, an image can be recorded with a resolution that is twice that of the pitch P of the ejection orifices 7 in the nozzle arrays Lc and Ld. In this embodiment, in the nozzle arrays Lc and Ld, the multiple supply ports 2A are arranged at the same pitch P as that of the energy-generating elements 6 and the ejection orifices 7 and positioned alternately so as to be adjacent to the energy-generating elements 6. The same applies to the other nozzle array groups C1, Y, M2, and C2.

In the liquid ejection head 19, the nozzle array group C1 and the nozzle array group C2 are positioned so as to be symmetric with respect to the nozzle array group Y, and the nozzle array groups M1 and M2 are positioned so as to be symmetric with respect to the nozzle array group Y, which enables so-called bidirectional recording to be performed. Thus, when the liquid ejection head 19 reciprocates (see arrows A1 and A2 illustrated in FIG. 1), the liquid ejection head 19 can eject inks of yellow, cyan, and magenta in the same order to record an image of high quality with color unevenness reduced. The energy-generating elements 6 and the ejection orifices 7 in the nozzle array group C1 are shifted from those in the nozzle array group C2 by ¼ of the pitch P (P/4). Similarly, the energy-generating elements 6 and the ejection orifices 7 in the nozzle array group M1 are shifted from those in the nozzle array group M2 by ¼ of the pitch P (P/4).

In the liquid chamber 5, a portion opposed to the energy generating element 6 and the ejection orifice 7 functions as a pressure chamber R. More specifically, the liquid chamber 5 includes multiple pressure chambers R communicating to each other. Each pressure chamber R is filled with ink through the supply port 2A from the common liquid chamber 4. In this embodiment, multiple nozzle filters 8 are provided around each pressure chamber R in the liquid chamber 5. Each nozzle filter 8 is a columnar member. A gap S between the columnar members (see FIG. 2) corresponding to an opening width of the nozzle filters 8 is smaller than an aperture D of each ejection orifice 7 (see FIG. 3). This can prevent a foreign matter larger than the ejection orifice 7 from entering the pressure chamber R.

In this embodiment, both ends of the supply port 2A in an X direction orthogonal to the nozzle array direction Y extend in the nozzle array direction Y, leaving a width d required for placing the wiring 10. In the liquid ejection head 19 with such a configuration, the energy-generating elements 6 are caused to generate heat based on recording data to generate bubbles in ink in the pressure chamber R. Then, the ink in the pressure chamber R is ejected from the ejection orifice 7 through use of the bubbling energy. The pressure chamber R after the ejection of ink is refilled with ink in the common liquid chamber 4 through the supply port 2A. When the liquid ejection head 19 is mounted on the liquid ejection recording apparatus 100 of a serial scanning system illustrated in FIG. 12, an image can be recorded as follows. An image can be recorded on a recording medium by repeating an operation of ejecting ink from the ejection orifice 7 and an operation of conveying a recording medium in the conveyance direction B while moving the liquid ejection head 19 in the main scanning direction A. At this time, two supply ports 2A are adjacent to each energy-generating element 6 in the nozzle array direction Y. Therefore, the pressure chamber R can be rapidly refilled with ink through the two supply ports 2A. In the case where each nozzle array group includes at least two nozzle arrays as in this embodiment, the pressure chamber R can be refilled with ink through two supply ports 2A adjacent to the energy-generating element 6 in the X direction, as well as the two supply ports 2A adjacent to the energy generating element 6 in the nozzle array direction Y. Therefore, the refilling speed can be further enhanced. Accordingly, the throughput can be enhanced by further increasing an ejection frequency of ink.

The length of the supply port 2A in the X direction is larger than the length of the energy-generating element 6 in the X direction. Thus, the pressure generated when driving the energy-generating element 6 is absorbed sufficiently by the wide supply port, and hence, the influence on the pressure chambers adjacent in the nozzle array direction Y can be alleviated.

Particularly, in this embodiment, the two supply ports 2A surround the four sides of the energy-generating element 6 except a portion in which the wiring 10 is placed, and hence the pressure chamber R can be rapidly refilled with ink. More specifically, after the ink in the pressure chamber R is ejected through use of bubbling of ink generated on the energy-generating element 6, the pressure chamber R can be more rapidly refilled with ink through the two supply ports 2A surrounding the four sides of the energy-generating element 6 discontinuously. Further, the pressure of the bubbles generated on the energy-generating element 6 is absorbed efficiently by the supply ports 2A. Thus, the cross talk can be alleviated. In the case where the nozzle array group includes two nozzle arrays as in this embodiment, both ends of the two supply ports 2A adjacent to the energy-generating element 6 in the nozzle array direction Y and the supply ports 2A adjacent to the energy-generating element 6 in the X direction are allowed to absorb the pressure of the bubbles in the pressure chamber R. Thus, the cross talk acting in the X direction as well as the cross talk acting in the nozzle array direction Y can be alleviated. The liquid ejection head 19 of this embodiment can satisfy both the enhancement of the refilling speed and the alleviation of the cross talk, which generally contradict each other.

Further, in the liquid ejection head 19 of this embodiment, a foreign matter such as dust having entered through the supply port 2A can be prevented from entering the pressure chamber R by the nozzle filter 8. Therefore, the appropriate ejection state of ink can be kept stably. Further, the supply port 2A is positioned between two pressure chambers R adjacent to each other in the nozzle array direction Y, and hence the supply port 2A is shared by the two pressure chambers R. Therefore, the substrate 2 can be reduced in size, compared with the configuration in which multiple supply ports 2A are provided separately for each pressure chamber R. As a result, the liquid ejection head 19 can also be reduced in size.

As described above, an image of high quality can be recorded at a high speed by increasing an ejection frequency of ink to enhance a throughput and allowing the supply port 2A to absorb a pressure generated in the pressure chamber R efficiently to alleviate a cross talk. Further, an image with a high resolution can be recorded bidirectionally by the nozzle array group formed of two nozzle arrays as illustrated in FIG. 1.

Second Embodiment

Figure 5:
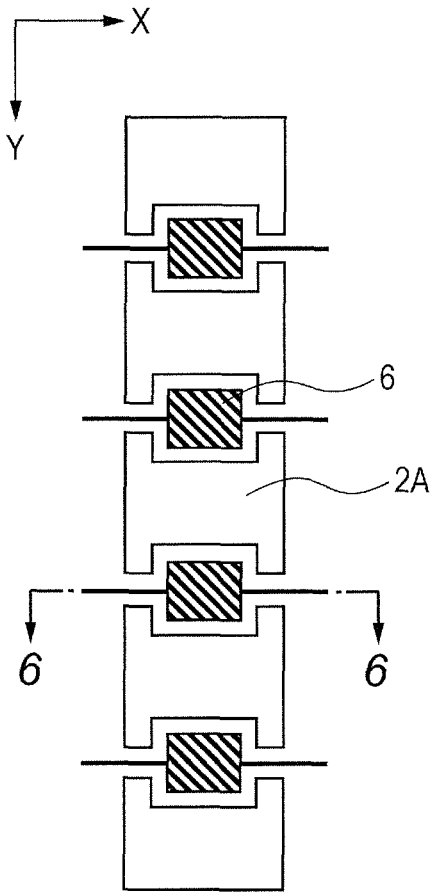
FIG. 5 is a plan view illustrating main parts of a liquid ejection head of a second embodiment of the present invention.
Figure 6:
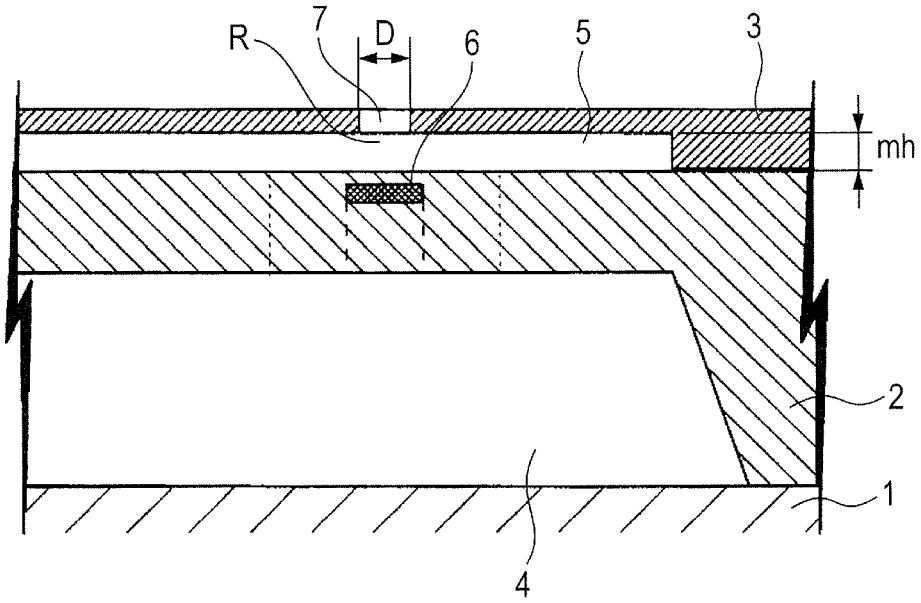
FIG. 6 is a cross-sectional view taken along a line 6-6 illustrated in FIG. 5.

FIG. 5 is a plan view illustrating main parts of a liquid ejection head of a second embodiment of the present invention. FIG. 6 is a cross-sectional view taken along a line 6-6 illustrated in FIG. 5. The constituent elements similar to those of the liquid ejection head of the above-mentioned embodiment are denoted with the same reference symbols as those therein, and the detailed descriptions thereof are omitted. The plan view of FIG. 5 illustrates a state in which the orifice plate 3 illustrated in FIG. 6 is removed.

In this embodiment, the height mh of the liquid chamber 5 (pressure chamber R) formed between the substrate 2 and the orifice plate 3 is smaller than the aperture D of the ejection orifice 7, and the nozzle filter 8 is not provided. The height mh of the liquid chamber 5 (pressure chamber R) is smaller than the aperture D of the ejection orifice 7, and therefore a foreign matter larger than the ejection orifice 7 does not enter the liquid chamber 5, and a foreign matter is prevented from entering the pressure chamber R. In the liquid ejection head of this embodiment, although the height mh of the pressure chamber R is smaller than that of the first embodiment, the nozzle filter 8 is not provided. Therefore, the flow resistance of ink does not become larger compared with the first embodiment, and ink can be ejected at a high frequency in the same way as in the first embodiment.

Third Embodiment

Figure 7:
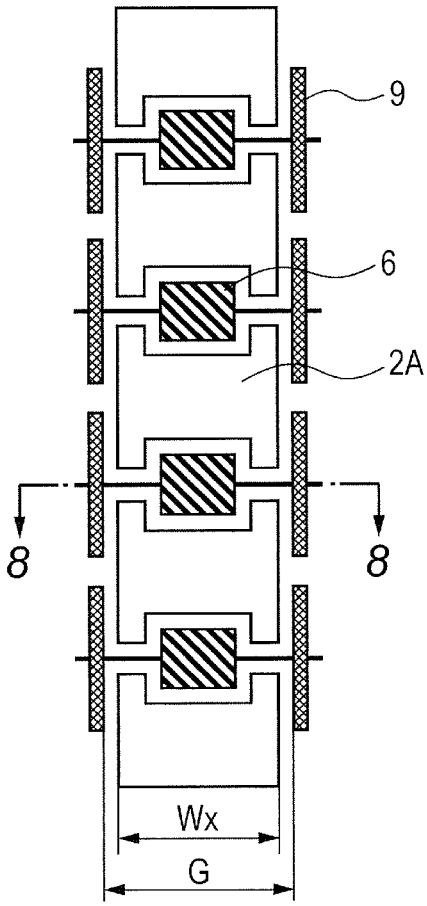
FIG. 7 is a plan view illustrating main parts of a liquid ejection head of a third embodiment of the present invention.
Figure 8:
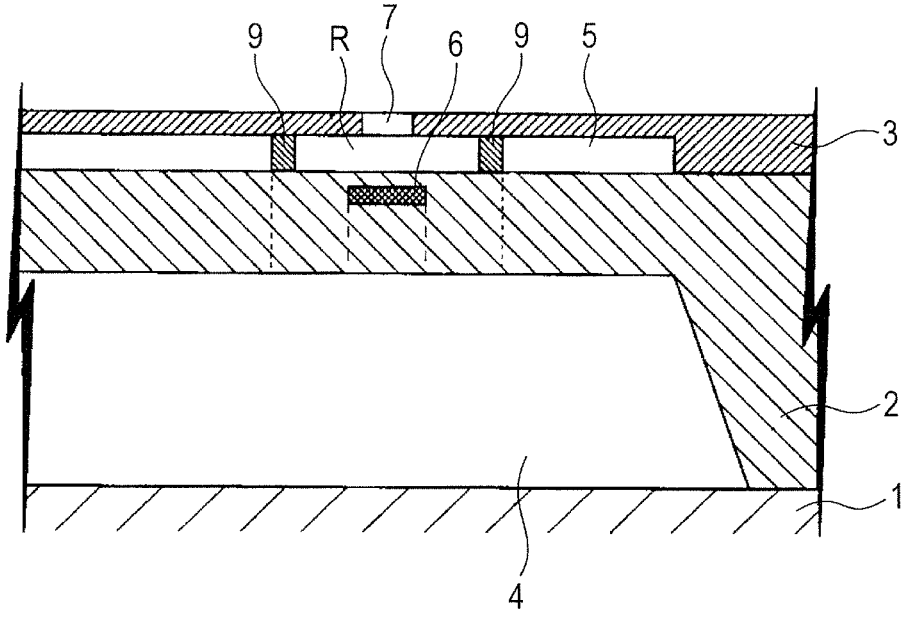
FIG. 8 is a cross-sectional view taken along a line 8-8 illustrated in FIG. 7.

FIG. 7 is a plan view illustrating main parts of a liquid ejection head of a third embodiment of the present invention. FIG. 8 is a cross-sectional view taken along a line 8-8 illustrated in FIG. 7. Hereinafter, the constituent elements similar to those of the liquid ejection head of the first embodiment are denoted with the same reference symbols as those therein, and the detailed descriptions thereof are omitted. The plan view of FIG. 7 illustrates a state in which the orifice plate 3 illustrated in FIG. 8 is removed.

In the liquid ejection head of this embodiment, a pair of flow path walls 9 is provided in the liquid chamber 5. The pair of flow path walls 9 sandwiches the pressure chamber R from the outside of the supply ports 2A in the X direction to support the orifice plate 3. Each flow path wall 9 extends substantially in parallel to the nozzle array direction Y. The gap G between the flow path walls 9 in the X direction is approximately Wx+100 μm or less, where Wx is the width of the supply port 2A in the X direction (see FIG. 7). The flow path walls 9 are positioned outside of the supply port 2A, and hence, a cross talk can be alleviated without preventing the refilling of the pressure chamber R through the supply port 2A. As a result, in the same way as in the above-mentioned embodiments, a cross talk between the pressure chambers R can be reduced while a high ink ejection frequency is kept. Further, the strength of the orifice plate 3 can be increased.

In this embodiment, the flow path wall 9 extends discontinuously in the nozzle array direction Y. However, even when the flow path walls 9 are integrated over the entire nozzle array, similar effects are obtained.

Fourth Embodiment

Figure 9A:
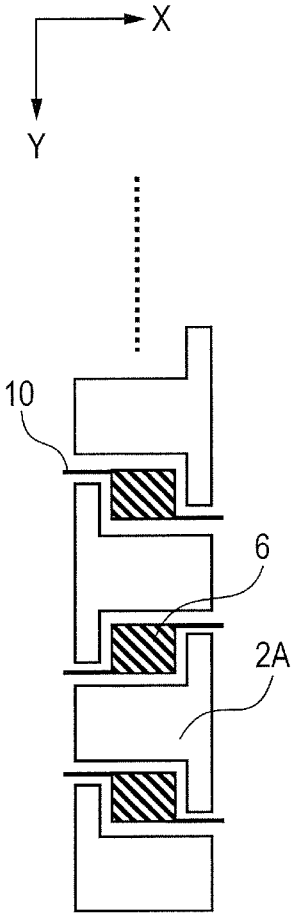
FIGS. 9A, 9B, and 9C are plan views illustrating main parts of a liquid ejection head of a fourth embodiment of the present invention.
Figure 9B:
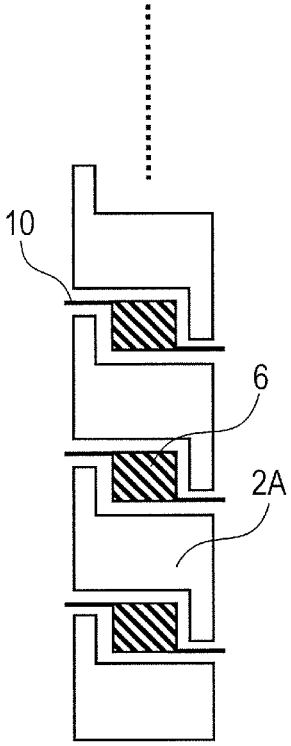
Figure 9C:
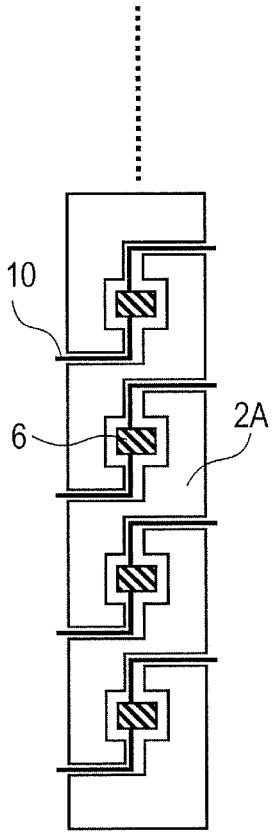

FIGS. 9A to 9C are plan views illustrating main parts of a liquid ejection head of a fourth embodiment of the present invention. The constituent elements similar to those of the liquid ejection head of the above-mentioned embodiments are denoted with the same reference symbols as those therein, and the detailed descriptions thereof are omitted.

In the liquid ejection head illustrated in FIG. 9A, the wiring 10 extends from a portion other than the center of the energy-generating element 6, and the layout of the wiring 10 varies alternately in the nozzle array direction Y. The supply ports 2A have a T-shape and are placed with their directions alternately reversed in the nozzle array direction Y to be adapted to the layout of the wiring 10.

In the liquid ejection head illustrated in FIG. 9B, the wiring 10 extends from a portion other than the center of the energy-generating element 6, and the layouts of the wiring 10 are uniform. The supply ports 2A adapted to the wiring layout have a shape in which both ends in the X direction extend in mutually opposite directions in the nozzle array direction Y.

In the liquid ejection head illustrated in FIG. 9C, the wiring 10 extends from the energy-generating element 6 in the nozzle array direction Y, and then, is bent in the X direction. The supply ports 2A adapted to the wiring layout have a shape in which a center portion is narrower than that of the supply port 2A illustrated in FIG. 9B.

The liquid ejection heads illustrated in FIGS. 9A to 9C have no nozzle filter 8. However, even if the liquid ejection heads have the nozzle filter 8, similar effects are obtained.

Fifth Embodiment

Figure 10A:
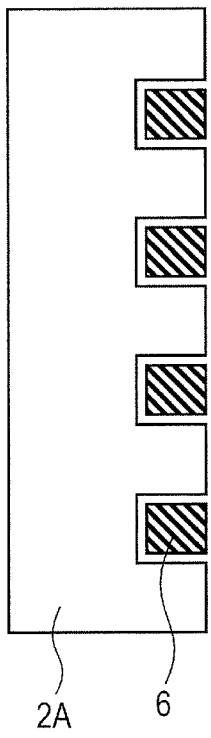
FIGS. 10A, 10B, and 10C are plan views illustrating main parts of a liquid ejection head of a fifth embodiment of the present invention.
Figure 10B:
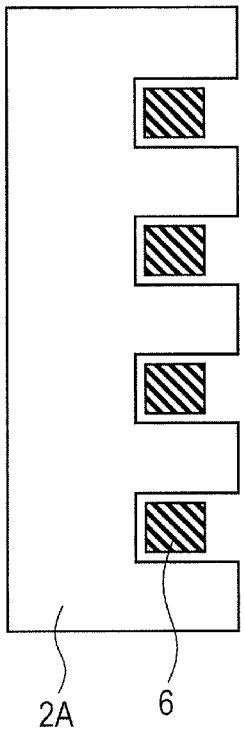
Figure 10C:
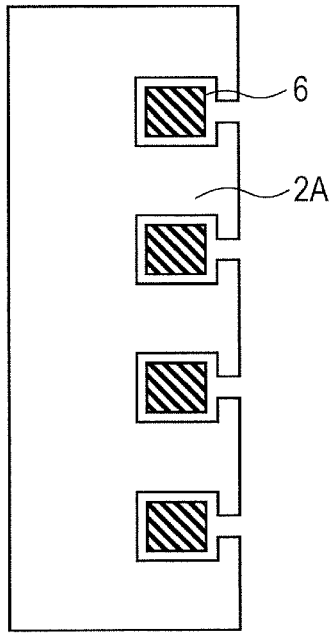

FIGS. 10A to 10C are plan views illustrating main parts of a liquid ejection head of a fifth embodiment of the present invention. The constituent elements similar to those of the liquid ejection head of the above-mentioned embodiments are denoted with the same reference symbols as those therein, and the detailed descriptions thereof are omitted.

In the liquid ejection heads illustrated in FIGS. 10A and 10B, the supply port 2A formed in a comb shape surrounds three sides of each energy-generating element 6 continuously. In the liquid ejection head illustrated in FIG. 10C, one supply port 2A surrounds three sides of each energy-generating element 6 continuously and surrounds the remaining one side discontinuously. In the liquid ejection heads illustrated in FIGS. 10A to 10C, the wiring 10 (not shown) extends from a portion not surrounded by the supply port 2A of the circumference of each energy-generating element 6.

In the liquid ejection heads illustrated in FIGS. 10A to 10C, the plane area of the supply port 2A is larger than that of the other embodiments, and hence, the flow resistance of ink is smaller. Thus, the ink ejection frequency can be increased by the enhanced refilling speed.

The liquid ejection heads illustrated in FIGS. 10A to 10C have no nozzle filter 8. However, even if the liquid ejection heads have the nozzle filter 8, similar effects are obtained.

Sixth Embodiment

Figure 11A:
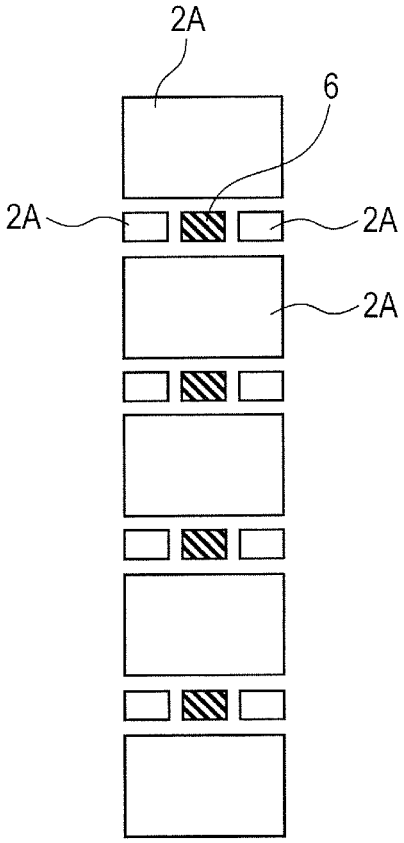
FIGS. 11A and 11B are plan views illustrating main parts of a liquid ejection head of a sixth embodiment of the present invention.
Figure 11B:
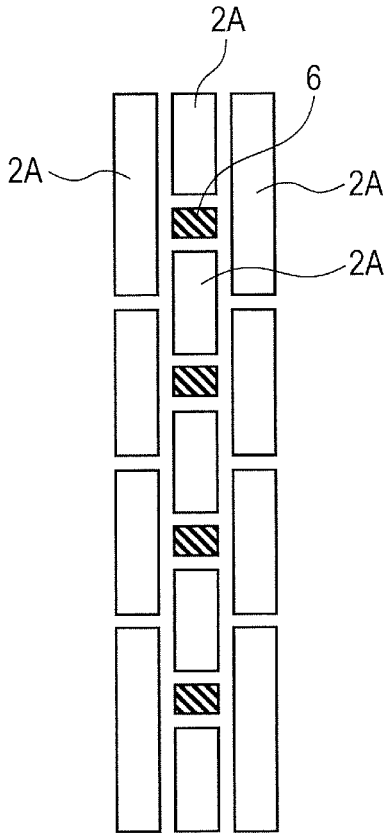

FIGS. 11A and 11B are plan views illustrating main parts of a liquid ejection head of a sixth embodiment of the present invention. The constituent elements similar to those of the liquid ejection head of the above-mentioned embodiments are denoted with the same reference symbols as those therein, and the detailed descriptions thereof are omitted.

In the liquid ejection heads illustrated in FIGS. 11A and 11B, the four sides of one energy-generating element 6 are surrounded discontinuously by four supply ports 2A. This increases portions through which the wiring 10 can pass and increases the degree of freedom of wiring layout, compared with the other embodiments.

In the above-mentioned embodiments, although the energy-generating element 6 is an electrothermal conversion element (heater), the energy-generating element 6 may be a piezoelectric element. In particular, when the energy-generating element 6 is a thin film piezoelectric element, a high-speed drive close to that of the electrothermal conversion element can be performed.

Further, in the above-mentioned embodiments, although the ejection medium is ink, the ejection medium may be other liquids. In particular, ejection media used for industrial purposes have a higher viscosity than that of ink-jet ink in most cases, and the refilling frequency thereof tends to decrease. Thus, the problem of the low refilling frequency can be solved by using the liquid ejection head of the present invention for such high-viscosity liquid.

Further, the liquid ejection head of the present invention only needs to be configured as follows. The multiple pressure chambers R to be supplied with ink through the supply ports 2A are arranged in the nozzle array direction Y, and each pressure chamber R ejects liquid filled in the pressure chamber R from the ejection orifice 7 through use of the energy-generating element 6. Thus, the present invention can be widely applied to liquid ejection heads with such a configuration. For example, the present invention can be applied to a recording head used in a liquid ejection head of a so-called full-line type, as well as a recording head used in a liquid ejection recording apparatus of a serial scanning type as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-172092, filed Aug. 5, 2011, which is hereby incorporated by reference herein in its entirety.

What is claimed is:

1. A liquid ejection head, comprising:

a substrate including a plurality of energy-generating elements for generating energy to be used for ejecting a liquid, and a supply port that is a through-hole for supplying the liquid to at least one of the energy-generating elements; and an orifice plate including ejection orifices for ejecting the liquid, wherein the plurality of the energy-generating elements are arranged in a first direction, wherein the supply port is formed between the plurality of the energy-generating elements in the first direction, and the supply port is formed so as to be adjacent to the energy-generating elements in a second direction orthogonal to the first direction, and wherein each of the energy-generating elements has a rectangular shape, and one supply port surrounds at least three sides of the energy-generating element continuously.

2. A liquid ejection head according to claim 1, further comprising a plurality of supply ports, wherein the energy-generating elements are formed between the supply ports in the second direction.

3. A liquid ejection head according to claim 1, further comprising wiring connected to the energy-generating element, the wiring being formed so as to extend in the second direction.

4. A liquid ejection head according to claim 1, wherein a dimension of the supply port in the second direction is greater than a dimension of each of the energy-generating elements in the second direction.

5. A liquid ejection head according to claim 1, further comprising a plurality of filter elements of a columnar shape which are formed around the energy-generating elements.

6. A liquid ejection head according to claim 1, further comprising a liquid chamber formed between the substrate and the orifice plate, wherein a height of the liquid chamber is smaller than a diameter of the ejection orifices.

7. A liquid ejection head according to claim 1, further comprising a wall member which is formed outside of the supply port in the second direction and is in contact with the substrate and the orifice plate.

8. A liquid ejection head according to claim 1, wherein a plurality of arrays of the energy-generating elements arranged in the first direction are arranged in the second direction.

* * * * *